US006030269A

United States Patent [19]

Drumm

[11] Patent Number: 6,030,269

[45] Date of Patent: Feb. 29, 2000

[54] METHOD FOR FORMING A MULTI-LEVEL CONDUCTIVE BLACK MATRIX FOR A FLAT PANEL DISPLAY

[75] Inventor: Paul M. Drumm, San Jose, Calif.

[73] Assignee: Candescent Technologies Corporation, San Jose, Calif.

[21] Appl. No.: 09/085,396

[22] Filed: May 26, 1998

Related U.S. Application Data

[62] Division of application No. 08/828,705, Mar. 31, 1997, Pat. No. 5,818,162.

[51] Int. Cl.[7] ..... H01J 9/14

[52] U.S. Cl. ..... 445/52; 445/24

[58] Field of Search ..... 445/52, 24; 427/64, 427/68; 430/315, 25, 312

[56] References Cited

U.S. PATENT DOCUMENTS 5,858,619 1/1999 Chang et al. ..... 430/312

*Primary Examiner*—Vip Patel
*Assistant Examiner*—Michael J. Smith
*Attorney, Agent, or Firm*—Wagner, Murabito & Hao LLP

[57] ABSTRACT

A multi-level conductive matrix structure for separating rows and columns of sub-pixels on the faceplate of a flat panel display device. In one embodiment, the present invention is formed partially of a first plurality of conductive ridges which are disposed on the faceplate between respective adjacent rows of sub-pixel regions. The present invention is further formed of a second plurality of conductive ridges which are orthogonally oriented with respect to and integral with the first plurality of conductive ridges such that a matrix structure is formed. In the conductive matrix of the present invention, the second plurality of conductive ridges have a height which is greater than the height of the first plurality of conductive ridges such that a multi-level conductive matrix is formed. However, the height of the second plurality of conductive ridges decreases to approximately the height of the first plurality of conductive ridges at respective intersections of the first and second plurality of conductive ridges. In so doing, the present invention provides a multi-level conductive matrix for separating rows and columns of sub-pixels on the faceplate of a flat panel display device.

10 Claims, 4 Drawing Sheets

METHOD FOR FORMING A MULTI-LEVEL CONDUCTIVE BLACK MATRIX FOR A FLAT PANEL DISPLAY

This is a divisional of application Ser. No. 08/828,705 filed on Mar. 31, 1997, now U.S. Pat. No. 5,818,162.

FIELD OF THE INVENTION

The present claimed invention relates to the field of flat panel displays. More particularly, the present claimed invention relates to the black matrix of a flat panel display screen structure.

BACKGROUND ART

Sub-pixel regions on the faceplate of a flat panel display are typically separated by an opaque mesh-like structure commonly referred to as a black matrix. By separating sub-pixel regions, the black matrix prevents electrons directed at one sub-pixel from being "back-scattered" and striking another sub-pixel. In so doing, a conventional black matrix helps maintain a flat panel display with sharp resolution. In addition, the black matrix is also used as a base on which to locate structures such as, for example, support walls.

In one prior art black matrix, a very thin layer (e.g. approximately 2–3 microns) of a conductive material is applied to the interior surface of the faceplate surrounding the sub-pixel regions. Typically, the conductive black matrix is formed of a conductive graphite material. By having a conductive black matrix, excess charges induced by electrons striking the top or sides of the black matrix can be easily drained from the interior surface of the faceplate. Additionally, by having a conductive black matrix, electrical arcs occurring between field emitters of the flat panel display and the faceplate will be more likely to strike the black matrix. By having the electrical arcing occur between the black matrix and the field emitters instead of between the sub-pixels and the field emitters, the integrity of the phosphors and the overlying aluminum layer is maintained. Unfortunately, due to the relatively low height of such a prior art conductive black matrix, arcing can still occur from the field emitter to the sub-pixel regions. As a result of such arcing, phosphors and the overlying aluminum layer can be damaged. As mentioned above, however, the black matrix is also intended to prevent back-scattering of electrons from one sub-pixel to another sub-pixel. Thus, it is desirable to have a black matrix with a height which sufficiently isolates each sub-pixel from respective neighboring sub-pixels. However, due to the physical property of the conductive graphite material, the height of the black matrix is limited to the aforementioned 2–3 microns.

In another prior art black matrix, a non-conductive polyimide material is patterned across the interior surface of the black matrix In such a conventional black matrix, the black matrix has a uniform height of approximately 20–40 microns. Thus, the height of such a black matrix is well suited to isolating each sub-pixel from respective neighboring sub-pixels. As a result, such a black matrix configuration effectively prevents unwanted back-scattering of electrons into neighboring sub-pixels. Unfortunately, prior art polyimide black matrices are not conductive. As a result, even though the top edge of the polyimide black matrix is much closer than the sub-pixel region is to the field emitter, unwanted arcing can still occur from the field emitter to the sub-pixel regions. In a prior art attempt to prevent such arcing, a conductive coating (i.e. indium tin oxide (ITO)) is applied to the non-conductive polyimide black matrix ITO coated non-conductive black matrices are not without problems, however. For example, coating a non-conductive matrix with ITO adds increased complexity and cost to the flat panel display manufacturing process. Also, the high atomic weight of ITO results in unwanted back-scattering of electrons. Furthermore, ITO has a undesirably high secondary emission coefficient, $\delta$.

Thus, a need exists for conductive black matrix structure having sufficient height to effectively separate neighboring sub-pixels. A further need exists for a black matrix structure which reduces arcing from the field emitters to the sub-pixels. Still another need exists for a conductive black matrix which does not have the increased cost and complexity, the increased back-scattering rate, and the undesirably high secondary emission coefficient associated with an ITO coated black matrix structure.

SUMMARY OF INVENTION

The present invention provides a conductive black matrix structure having sufficient height to effectively separate neighboring sub-pixels. The present invention also provides a black matrix structure which reduces arcing from the field emitters to the sub-pixels. The present invention further provides a conductive black matrix which does not have the increased cost and complexity, the increased back-scattering rate, and the undesirably high secondary emission coefficient associated with an ITO coated black matrix structure.

Specifically, in one embodiment, the present invention is formed partially of a first plurality of conductive ridges which are disposed on the faceplate between respective adjacent rows of sub-pixel regions. The present invention is further formed of a second plurality of conductive ridges which are orthogonally oriented with respect to and integral with the first plurality of conductive ridges such that a matrix structure is formed. In the conductive matrix of the present invention, the second plurality of conductive ridges have a height which is greater than the height of the first plurality of conductive ridges such that a multi-level conductive matrix is formed. However, the height of the second plurality of conductive ridges decreases to approximately the height of the first plurality of conductive ridges at respective intersections of the first and second plurality of conductive ridges. In so doing, the present invention provides a multi-level conductive matrix for separating rows and columns of sub-pixels on the faceplate of a flat panel display device.

In another embodiment, the present invention includes the features of the above-described embodiment, and further recites that each of the first plurality of conductive ridges disposed between the respective rows of the sub-pixel regions has a height of approximately 18–20 microns. In this embodiment, each of the second plurality of conductive ridges disposed between the respective columns of the sub-pixel regions has a maximum height of approximately 30–40 microns.

In yet another embodiment, the present invention provides a method for forming a multi-level conductive matrix structure for separating rows and columns of sub-pixels on the faceplate of a flat panel display device. In this embodiment, the present invention defines sub-pixel regions on the interior surface of the faceplate of the flat panel display device by forming rows and columns of photoresist structures thereon. The photoresist structures are formed on the faceplate directly overlying the areas which are to be used as sub-pixel regions. Conductive material is then applied between the photoresist structures, and is slightly hardened. In this embodiment, the photoresist structures are spaced such that the conductive material resides at a first height between the rows of the photoresist structures, and resides at a second height between the columns of the photoresist structures, wherein the first height is less than the second height. After the hardening step, acetone is applied to the photoresist structures to remove the photoresist structures from the faceplate. In so doing, the present invention forms a multi-level matrix of the conductive material on the faceplate of the flat panel display structure.

In still another embodiment, the present invention includes all of the steps of the above-described method, and further recites that rows of the photoresist structures are separated from adjacent rows of the photoresist structures by a distance of approximately 75–80 microns. In this embodiment, columns of the photoresist structures are separated from adjacent columns of the photoresist structures by a distance of approximately 25–30 microns. Additionally, in this embodiment, the second height of the conductive material residing between the columns of the photoresist structures decreases to the first height at respective locations where the conductive material residing between the columns of the photoresist structures intersects the conductive material residing between the rows of the photoresist structures.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrates embodiments of the invention and, together with the description, serve to explain the principles of the invention.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
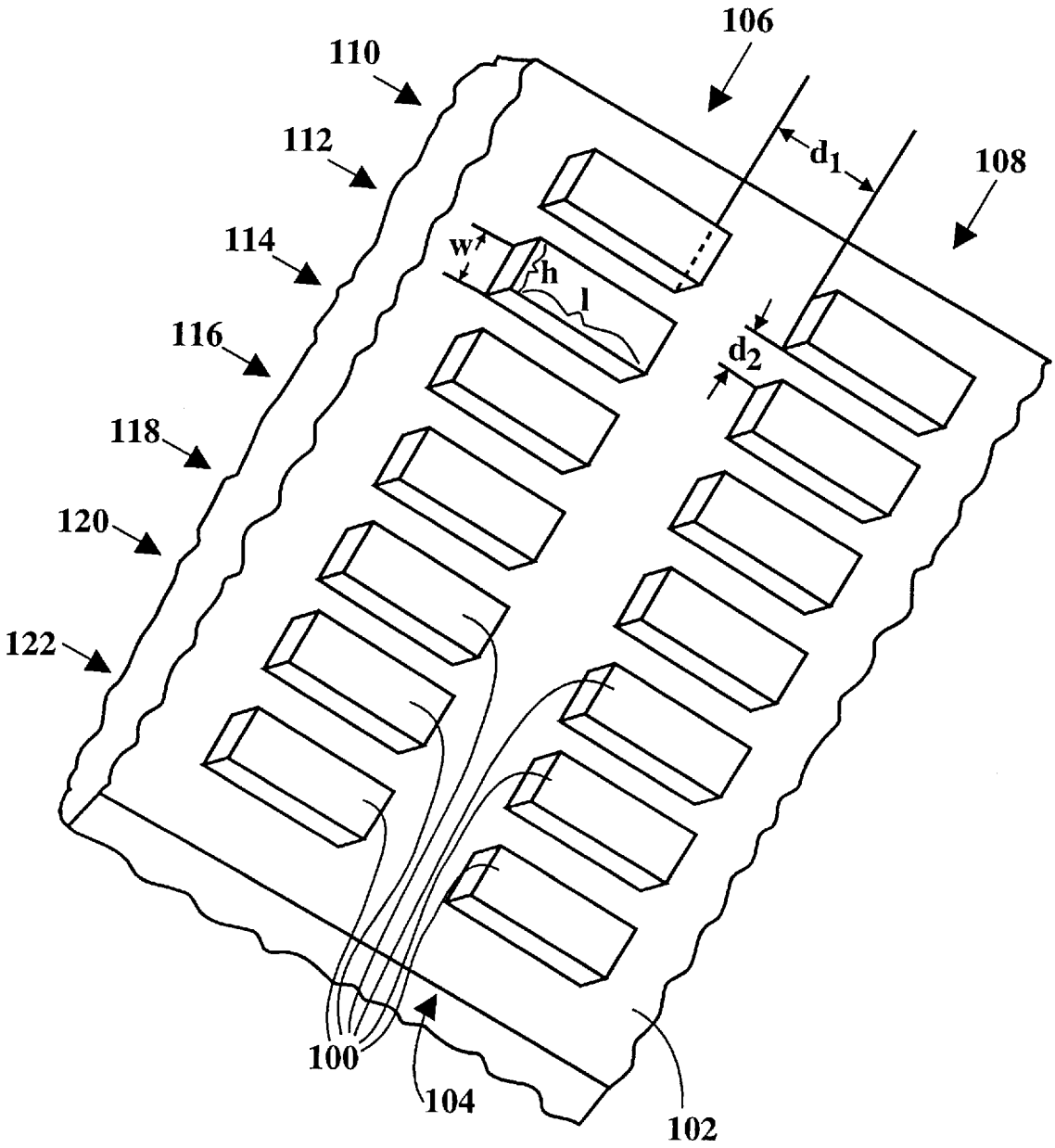
FIG. 1 is a simplified perspective view of photoresist structures created during the formation of a multi-level conductive matrix structure in accordance with the present claimed invention.

With reference to FIG. 1 of the present embodiment, a simplified perspective view of photoresist structures 100 created during the formation of a multi-level conductive matrix structure in accordance with the present claimed invention is shown. The present invention is comprised of a multi-level conductive black matrix for separating rows and columns of sub-pixels on the faceplate of a flat panel display device. Although a the present invention is referred to as a black matrix, it will be understood that the term "black" refers to the opaque characteristic of the matrix. Thus, the present invention is also well suited to having a color other than black. To form the present invention, photoresist structures 100 are formed on the interior surface 102 of a faceplate 104. Only a portion of the interior surface of a faceplate is shown in FIG. 1 for purposes of clarity. In the present embodiment, photoresist structures 100 are formed by applying a photoresist such as, for example, AZ4620 Photoresist, available from Hoechst-Celanese of Somerville, N.J., to interior surface 102 of faceplate 104. Next, the photoresist is cured, soft-baked, exposed, and developed such that only hardened photoresist structures 100 remain on faceplate 104. In the present invention photoresist structures 100 are formed on faceplate 104 directly overlying the regions in which sub-pixels are to be formed. Furthermore, in the present embodiment, photoresist structures 100 are formed having a width, w, of approximately 65 microns, a height, h, of approximately 40 microns, and a length, l, of approximately 215 microns. Although such dimensions are specified for photoresist structures 100 in the present embodiment, the present invention is also well suited to using various other dimensions for photoresist structures 100.

With reference still to FIG. 1, photoresist structures 100 are formed on faceplate 104 arranged in rows (shown as 106 and 108) and columns (shown as 110 through 122). Although only two rows, 106 and 108, and only seven columns 110 through 122 of photoresist structures are shown in FIG. 1 for purposes of clarity, it will be understood that numerous rows and columns of photoresist structures will be formed on the interior surface of a faceplate. In one embodiment, adjacent rows 106 and 108 of photoresist structures 100 are separated from each other by a first distance, $d_1$. Simiarly, adjacent columns (e.g. columns 110 and 112) are separated by a second distance, $d_2$. In the present embodiment, $d_2$ is less than $d_1$. More specifically, in the present embodiment, adjacent rows 106 and 108 of photoresist structures 100 are separated by a distance of approximately 75–80 microns. Adjacent columns (e.g. columns 110 and 112) are separated by a distance of approximately 25–30 microns. Although such row and column separation distances are specified in the present embodiment, the present invention is also well suited to separating adjacent rows and adjacent columns by various other distances.

Figure 2:
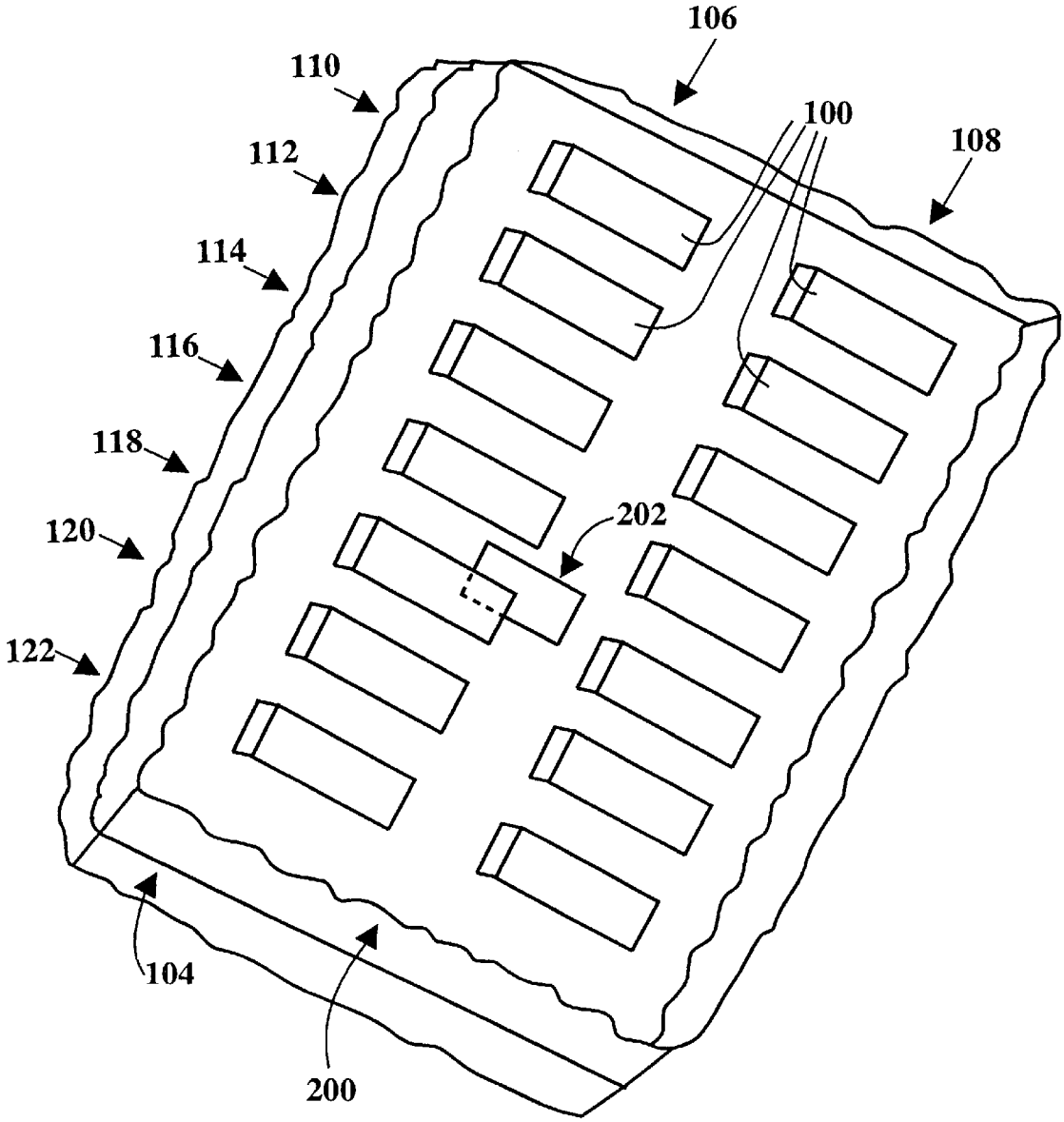
FIG. 2 is a simplified perspective view of the photoresist structures of FIG. 1 with a layer of conductive material disposed thereon in accordance with the present claimed invention.

With reference next to FIG. 2, after photoresist structures 100 have been formed, a conductive material 200 is applied between photoresist structures 100. More specifically, in one embodiment, conductive material 200 is sprayed over the interior surface of faceplate 104 and photoresist structures 100 such that the conductive material is disposed over and between photoresist structures 100. In the present embodiment, conductive material 200 is comprised of, for example, a CB800A DAG made by Acheson Colloids of Port Huron, Mich. Next, in the present embodiment, excess conductive material 200 disposed above and/or on top of photoresist structures 100 is removed by squeegeeing conductive material 200 from the top surface of photoresist structures 100. Although the present embodiment specifically recites spraying DAG over the interior surface of faceplate 200, the present invention is also well suited to using various other deposition methods to deposit various other conductive materials over the interior surface of faceplate 104 and between photoresist structures 100.

Referring still to FIG. 2, due to the difference in separation distances between adjacent rows (106 and 108) and adjacent columns (e.g., 110 and 112), the conductive material resides at a first height between the rows 106 and 108 of photoresist structures 100, and resides at a second height between columns 110 and 122 of photoresist structures 100. The first height of conductive material 200 between the rows of photoresist structures 100 is less than the second height of conductive material 200 between the columns of photoresist structures 100. That is, capillary action causes conductive material 200 located between the narrowly separated columns 110–122 of photoresist structures 100 to reside at a greater height than the height at which conductive material 200 resides between the more widely separated rows 106 and 108 of photoresist structures 100. In the present embodiment, the first height of conductive material 200 residing between the rows of photoresist structures 100 is approximately 18–20 microns. The second height of conductive material 100 residing between the columns of photoresist structures 100 is approximately 30–40 microns. Although such heights are recited in the present embodiment, the present invention is also well suited to varying the height of conductive material 200. Such variations in the height of conductive material 200 are achieved by, for example, varying the amount of conductive material applied to faceplate 104, varying the viscosity of conductive material 200, or varying the spacing between photoresist structures 100.

With reference still to FIG. 2, at various locations, the conductive material residing between columns 110–122 of photoresist structures 100 intersects the conductive material residing between rows 106 and 108 of photoresist structures 100. Area 202 of FIG. 2 represents a location where conductive material residing between columns 116 and 118 intersects the conductive material residing between rows 106 and 108. At such an area (i.e., an intersection) the height of the conductive material residing between the columns of photoresist structures 100 decreases to the height of the conductive material residing between the rows. Thus, in the present embodiment, at area 202, the height of the conductive material residing between columns 116 and 118 decreases to approximately 18–20 microns.

After conductive material 200 has been applied, conductive material residing between photoresist structures 100 is hardened In the present embodiment, the DAG is baked at approximately 80–90 degrees Celsius for approximately 4–5 minutes. As a result, a hardened multi-level conductive matrix is formed overlying faceplate 104.

After conductive material 200 is hardened, the present invention removes photoresist structures 100. In the present embodiment, a technical grade acetone is applied to photoresist structures 100 to remove photoresist structures 100 from faceplate 104. As a result, only the present multi-level conductive matrix remains on faceplate 104. During subsequent processing steps, the sub-pixels of the flat panel display are formed in the gaps or openings resulting from the removal of photoresist structures 100. Thus, the multi-level conductive matrix of the present invention defines the locations of the sub-pixels to be formed on the surface of the faceplate.

Figure 3:
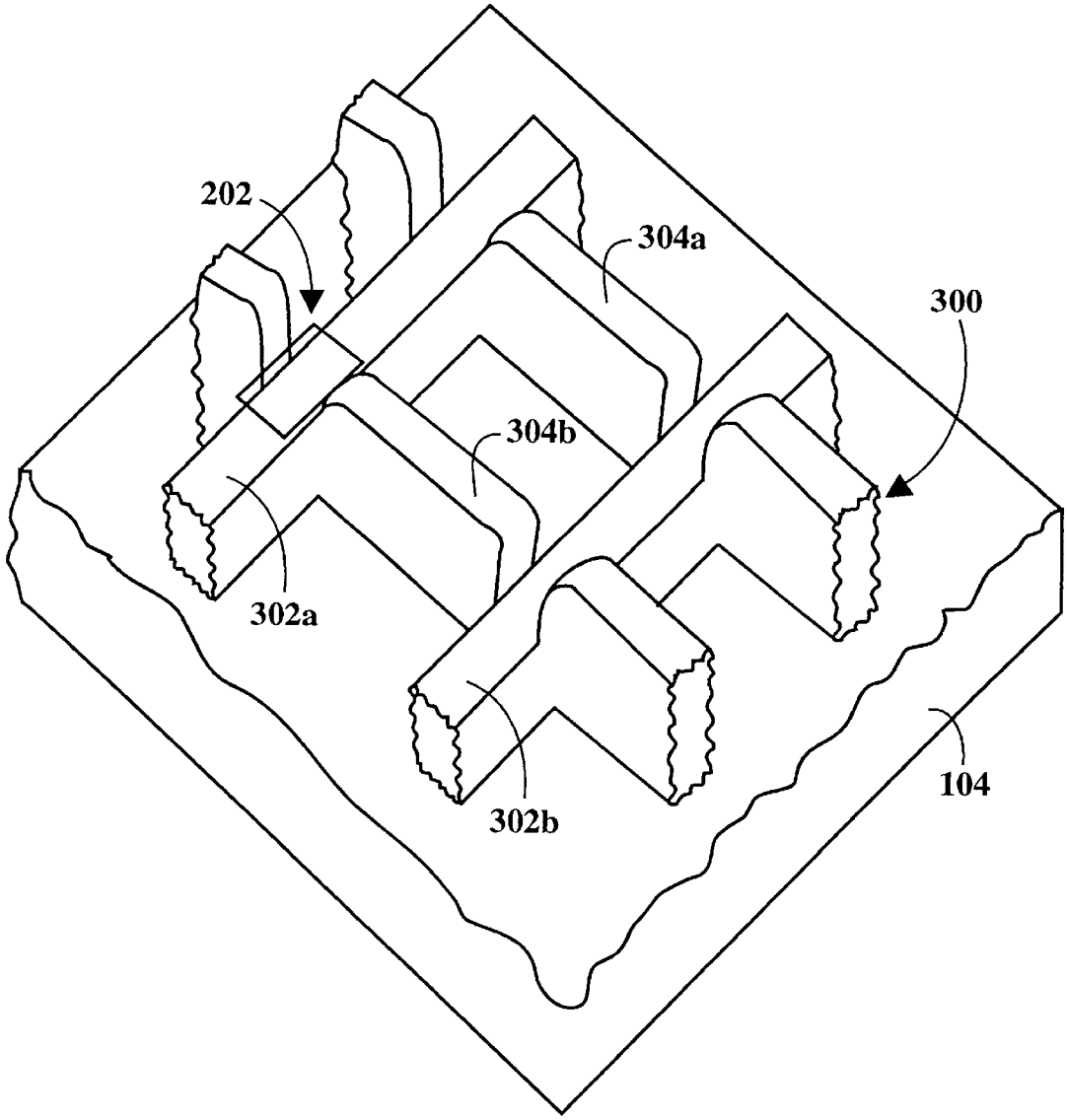
FIG. 3 is a perspective view of a multi-level conductive matrix structure in accordance with the present claimed invention.

With reference now to FIG. 3, a perspective view of the present multi-level conductive matrix 300 of the present invention is shown disposed on a faceplate 104. As shown in FIG. 3, multi-level conductive matrix 300 has portions, typically shown as 304*a* and 304*b*, which separate columns of sub-pixels. Multi-level conductive matrix 300 also has portions, typically shown as 302*a* and 302*b* which separates row of sub-pixels. As shown in FIG. 3, column separating portions 304*a* and 304*b* of the present multi-level conductive matrix 300 are taller than row separating portions 302*a* and 302*b*. More specifically, as mentioned above, the height of conductive material 200 forming the present multi-level conductive matrix is approximately 18–20 microns along row separating portions 302*a* and 302*b*. The height of conductive material 200 forming the present multi-level conductive matrix is approximately 30–40 microns along column separating portions 304*a* and 304*b*. The substantial height of the present multi-level conductive matrix 300 effectively isolates neighboring sub-pixels and prevents unwanted back-scattering. The substantial height and conductivity of the present multi-level conductive matrix prevent arcing from the field emitters to the faceplate. By preventing arcing from the field emitters to the faceplate, the present invention increases the high voltage robustness of the flat panel display in which multi-level conductive matrix 300 is employed. Furthermore, the conductive nature of the present invention 300 allows excess charge to be readily removed from the faceplate of the flat panel display. The present invention achieves the above-mentioned accomplishments without requiring the application of an ITO coating.

Referring still to FIG. 3, at area 202, for example, column separating portion 304*b* intersects row separating portion 302*a*. At area 202 the height of column separating portion 304*b* decreases to the height of row separating portion 302*a*. Thus, in the present embodiment, at area 202, the height of column separating portion 304*b* decreases to approximately 18–20 microns.

Figure 4:
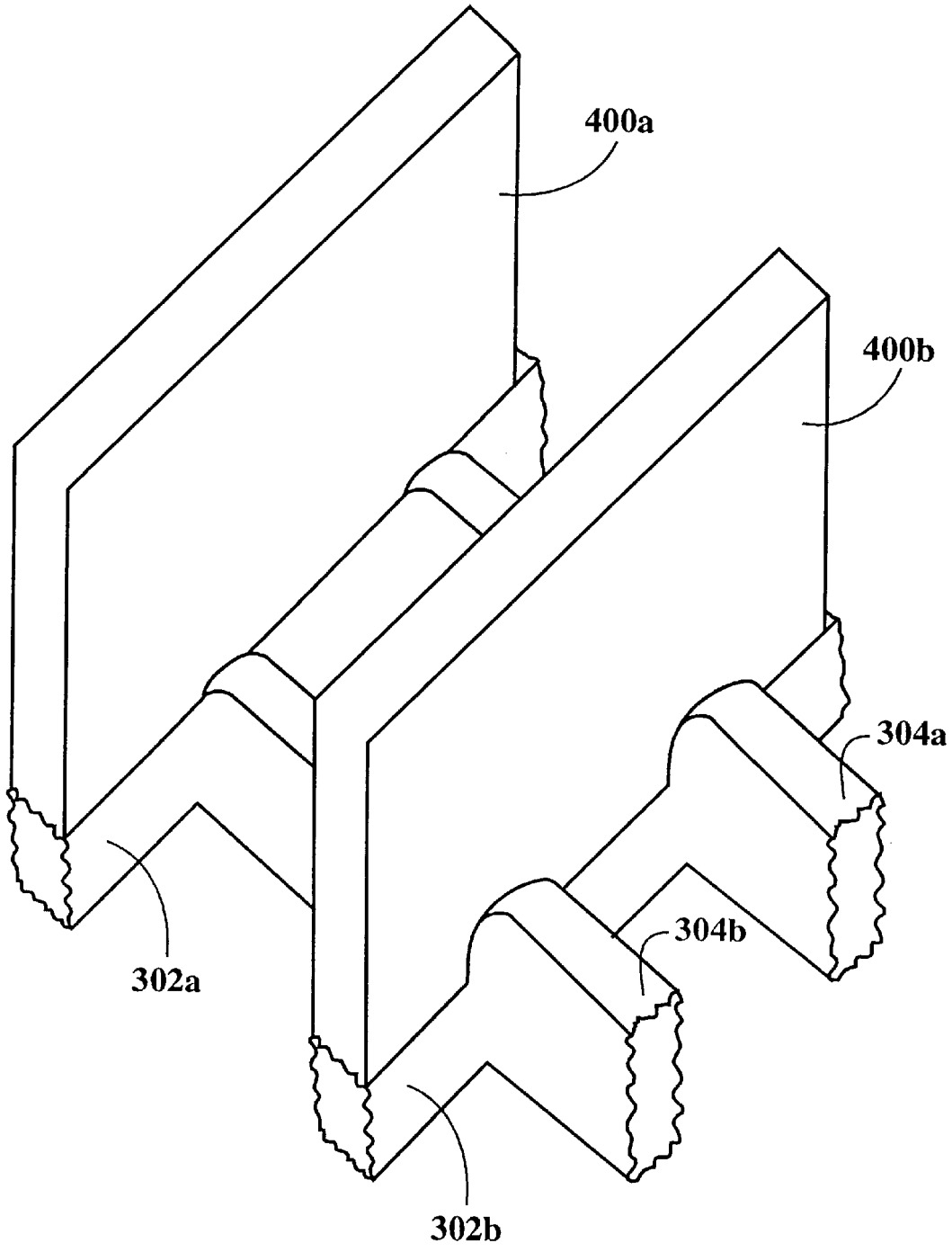
FIG. 4 is a perspective view of a multi-level conductive matrix structure having a support structure disposed thereon in accordance with the present claimed invention.

Referring next to FIG. 4, in the present invention, the trough or dip in the height of column separating portions 304*a* and 304*b* at the intersections with row separating portions 302*a* and 302*b* is significantly advantageous. Specifically, the taller height of column separating portions 304*a* and 304*b* near the intersection with row separating portions 302*a* and 302*b* provides buttressing for support structures 400*a* and 400*b* disposed along row separating portions 302*a* and 302*b*. That is, a wall or rib (400*a* and 400*b*), or other support structure commonly located on row separating portions 302*a* and 302*b* is stabilized or buttressed by taller proximately located column separating portions 304*a* and 304*b*.

With reference back to FIG. 3, due to the aforementioned differences in separation distances between rows and columns of photoresist structures, multi-level conductive matrix 300 also has a varying thickness. That is, in the present embodiment, row separating portions 302*a* and 302*b* have a thickness of approximately 75–80 microns. Column separating portions 304*a* and 304*b*, on the other hand, have a thickness of approximately 25–30 microns.

Thus, the present invention provides a conductive black matrix structure having sufficient height to effectively separate neighboring sub-pixels. The present invention also provides a black matrix structure which reduces arcing from the field emitters to the sub-pixels. The present invention further provides a conductive black matrix which does not have the increased cost and complexity, the increased back-scattering rate, and the undesirably high secondary emission coefficient associated with an ITO coated black matrix structure.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications are suited to the particular use contemplated. It is intended that the scope of the invention be defined by the Claims appended hereto and their equivalents.

What is claimed is:

1. A method for forming a multi-level conductive matrix structure for separating rows and columns of sub-pixels on a faceplate of a flat panel display device, said method comprising the steps of:

a) defining sub-pixel regions on an interior surface of said faceplate of said flat panel display device by forming photoresist structures on said interior surface of said faceplate, said photoresist structures formed directly overlying said sub-pixel regions;

b) applying conductive material between said photoresist structures;

c) hardening said conductive material applied between said photoresist structures; and d) applying acetone to said photoresist structures to remove said photoresist structures from said faceplate such that a matrix of said conductive material remains on said faceplate of said flat panel display structure.

2. The multi-level conductive matrix forming method as recited in claim 1 wherein step a) further comprises the steps of:

a1) defining rows of said sub-pixel regions on said interior surface of said faceplate of said flat panel display by forming rows of said photoresist structures on said interior surface of said faceplate, said rows of said photoresist structures separated from adjacent rows of said photoresist structures by a first distance; and a2) defining columns of said sub-pixel regions on the interior surface of said faceplate of said flat panel display by forming columns of said photoresist structures on said interior surface of said faceplate, said columns of said photoresist structures separated from adjacent columns of said photoresist structures by a second distance which is less than said first distance.

3. The multi-level conductive matrix forming method as recited in claim 2 wherein step a1) further comprises the step of:

forming said rows of said photoresist structures on said interior surface of said faceplate such that said rows of said photoresist structures are separated from adjacent rows of said photoresist structures by a distance of approximately 75–80 microns.

4. The multi-level conductive matrix forming method as recited in claim 2 wherein step a2) further comprises the step of:

forming said columns of said photoresist structures on said interior surface of said faceplate such that said columns of said photoresist structures are separated from adjacent columns of said photoresist structures by a distance of approximately 25–30 microns.

5. The multi-level conductive matrix forming method as recited in claim 1 wherein step b) further comprises the steps of:

b1) applying said conductive material over said interior surface of said faceplate and said photoresist structures formed thereon such that said conductive material is disposed over and between the photoresist structures; and b2) removing said conductive material disposed over said photoresist structures by squeegeeing said conductive material from the top surface of said photoresist structures.

6. The multi-level conductive matrix forming method as recited in claim 2 wherein step b) further comprises the step of:

b1) applying said conductive material between said rows and said columns of said photoresist structures such that said conductive material resides at a first height between said rows of said photoresist structures, and resides at a second height between said columns of said photoresist structures, said first height being less than said second height.

7. The multi-level conductive matrix forming method as recited in claim 6 wherein step b1) further comprises the step of:

b2) applying said conductive material between said rows and said columns of said photoresist structures such that said conductive material has a thickness of approximately 75–80 microns between said rows of said photoresist structures, and has a thickness of approximately 25–30 microns between said columns of said photoresist structures.

8. The multi-level conductive matrix forming method as recited in claim 6 wherein step b1) further comprises the step of:

applying said conductive material between said rows and said columns of said photoresist structures such that said second height of said conductive material residing between said columns of said photoresist structures decreases to said first height at respective locations where said conductive material residing between said columns of said photoresist structures intersects said conductive material residing between said rows of said photoresist structures.

9. The multi-level conductive matrix forming method as recited in claim 6 wherein step b1) further comprises the step of:

applying said conductive material between said rows and said columns of said photoresist structures such that said first height of said conductive material residing between said rows of said photoresist structures is approximately 18–20 microns.

10. The multi-level conductive matrix forming method as recited in claim 6 wherein step b1) further comprises the step of:

applying said conductive material between said rows and said columns of said photoresist structures such that said second height of said conductive material residing between said columns of said photoresist structures is approximately 30–40 microns.

* * * * *